United States Patent [19]

Horie et al.

[11] Patent Number: 4,500,622

[45] Date of Patent: Feb. 19, 1985

[54] ELECTROPHOTOGRAPHIC LIGHT-SENSITIVE PRINTING MATERIALS

[75] Inventors: Seiji Horie; Junji Nakano; Masayoshi Nagata; Hideo Sato, all of Saitama, Japan

[73] Assignee: Fuji Photo Film Co., Ltd., Kanagawa

[21] Appl. No.: 356,541

[22] Filed: Mar. 9, 1982

[30] Foreign Application Priority Data

Mar. 9, 1981 [JP] Japan ..... 56-33579

[51] Int. Cl.[3] ..... G03G 5/00; G03G 5/14; G03G 5/04; G03G 5/06

[52] U.S. Cl. ..... 430/78; 430/58; 430/73; 430/76; 430/83; 430/96

[58] Field of Search ..... 430/96, 58, 83, 76, 430/78, 73

[56] References Cited

U.S. PATENT DOCUMENTS

| | | | |
|---|---|---|---|
| 3,408,183 | 10/1968 | Mammino | 430/83 |
| 3,481,735 | 12/1969 | Graver et al. | 430/96 |
| 3,740,218 | 6/1973 | Contois et al. | 430/83 |
| 4,018,606 | 4/1977 | Contois et al. | 430/83 |
| 4,150,987 | 4/1979 | Anderson et al. | 430/58 |
| 4,218,528 | 8/1980 | Shimada et al. | 430/96 |
| 4,395,473 | 7/1983 | Horie et al. | 430/76 |

FOREIGN PATENT DOCUMENTS

| | | | |
|---|---|---|---|
| 2129087 | 6/1970 | Fed. Rep. of Germany | 430/83 |
| 99440 | 8/1979 | Japan | 430/83 |
| 119926 | 9/1979 | Japan | 430/83 |

*Primary Examiner*—Edward Kimlin
*Assistant Examiner*—Merrell C. Cashion
*Attorney, Agent, or Firm*—Sughrue, Mion, Zinn, Macpeak, and Seas

[57] ABSTRACT

An electrophotographic light-sensitive printing material having a high sensitivity and forming a good printing plate capable of providing clear copies having less stains at non-image areas is disclosed. The material is comprised of a conductive support having formed thereon an electrophotographic light-sensitive layer containing (a) a hydrazone compound, (b) a barbituric acid derivative, a thiobarbituric acid derivative or other charge generating material, and (c) a resin binder.

8 Claims, No Drawings

ELECTROPHOTOGRAPHIC LIGHT-SENSITIVE PRINTING MATERIALS

FIELD OF THE INVENTION

This invention relates to novel electrophotographic light-sensitive printing materials used in electrophotography. More specifically, the invention relates to such materials comprised of a base plate having a specific electrophotographic light-sensitive layer formed thereon which contains (a) a hydrazone compound, (b) a barbituric acid derivative, thiobarbituric acid derivative or other charge generating material, and (c) a resin binder.

BACKGROUND OF THE INVENTION

Printing materials (plates for use in printing) to utilize electrophotography include zinc oxide-resin dispersion series offset printing plates as described in, for example, Japanese Patent Publication Nos. 47610/72, 40002/73, 18325/73, 15766/76, 25761/76, etc. In accordance with these techniques, toner images are formed by an electrophotographic process, and then the printing materials are wet with a desensitizing solution (for example, an aqueous acid solution containing a ferrocyanide or a ferricyanide) for desensitizing the non-image area before use. The press power of the offset printing plates subjected to such a treatment is about 5,000 to 10,000 sheets of copies. However, such plates are unsuitable for printing more than 10,000 sheets and if a composition suitable for desensitization is employed, difficulties occur. More specifically, electrostatic characteristics are degraded and image quality is reduced.

Organic photoconductor-resin series printing materials are described in Japanese Patent Publication Nos. 17162/62, 7758/63 and 39405/71, Japanese Patent Application (OPI) No. 2437/77 (U.S. Pat. No. 4,063,948) (the term "OPI" as used herein refers to a "published unexamined Japanese patent application"). The materials use an electrophotographic light-sensitive material prepared by forming a photoconductive insulating layer composed of an oxadiazole compound dispersed in a styrene-maleic anhydride copolymer as a binder on a grained aluminum sheet. A printing plate is produced using such a light-sensitive material by forming thereon a toner image. The toner image is formed by an electrophotographic process and then the non-image areas are dissolved away with an alkaline organic solvent solution.

However, in the foregoing printing materials, the organic photoconductor is different from the material used as the binder. When a large amount of the organic conductor is used for increasing the sensitivity of the printing materials, there is an undesirable reduction in the solubility of the organic photoconductor in the binder. Furthermore, there are other undesirable occurrences such as phase separation, and the occurrence of the crystallization of the organic photoconductor.

SUMMARY OF THE INVENTION

As the result of various investigations to overcome the above-described difficulties in conventional electrophotographic light-sensitive printing materials, the inventors have succeeded in obtaining the present invention.

An object of this invention is to provide an electrophotographic light-sensitive printing material having a high press life, a high sensitivity and which provides a clear image with less stain or fog at the nonimage areas.

Other object of this invention is to provide an electrophotographic light-sensitive material having a spectral sensitivity capable of recording by semiconductor laser, argon laser, He—Ne laser, etc.

A further object of this invention is to provide an electrophotographic light-sensitive printing material having excellent electrostatic characteristics such as charge retention, moisture resistance, etc.

Still other object of this invention is to provide an electrophotographic light-sensitive printing material having a light-sensitive layer which can be easily dissolved in an alkaline aqueous solution.

Other object of this invention is to provide an electrophotographic light-sensitive printing material which can be charged both positively and negatively for making both posi-posi (positive working) and nega-posi (negative working) printings using a single type of developer.

The above-described objects of this invention can be attained by the provision of the electrophotographic light-sensitive printing material of the present invention.

That is, according to this invention, there is provided:

(1) an electrophotographic light-sensitive printing material comprising a conductive base plate having formed thereon an electrophotographic light-sensitive layer comprising (a) a hydrazone compound, (b) at least one compound selected from the group consisting of a barbituric acid derivative, a thiobarbituric acid derivative, and other charge generating materials, and (c) a resin binder.

Also, according to the principal preferred embodiments of this invention, there are provided:

(2) the electrophotographic light-sensitive printing material described in (1) wherein the foregoing component (b) is at least one compound selected from the group consisting of a barbituric acid derivative and a thiobarbituric acid derivative;

(3) the electrophotographic light-sensitive printing material described in (1) wherein the foregoing component (b) is at least one kind of a phthalocyanine pigment selected from the group consisting of a metallic phthalocyanine and a non-metallic phthalocyanine;

(4) the electrophotographic light-sensitive printing material described in (1) wherein the foregoing component (b) is at least one kind of an azo dye selected from the group consisting of a monoazo dye and a disazo dye;

(5) the electrophotographic light-sensitive printing material described in (1) wherein the foregoing component (c) is a copolymer of styrene and maleic anhydride;

(6) the electrophotographic light-sensitive printing material described in (1) wherein the foregoing component (c) is a copolymer having a carboxy group represented by general formula (IX):

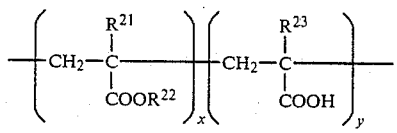

(IX)

wherein $R^{21}$ and $R^{23}$ are independently a hydrogen atom or a methyl group, $R^{22}$ represents an alkyl group having 1 to 18 carbon atoms or an aralkyl group having 7 to 12 carbon atoms, and the y/x ratio is 5–60/100;

(7) the electrophotographic light-sensitive printing material described in (6) wherein $R^{22}$ represents a benzyl group, a phenethyl group, or a 3-phenylpropyl group and the y/x ratio is 10–50/100; and (8) the electrophotographic light-sensitive printing material described in (1) wherein the foregoing component (c) is a novolak resin obtained by condensing phenol, o-cresol, m-cresol, or p-cresol and formaldehyde or acetaldehyde.

DETAILED DESCRIPTION OF THE INVENTION

Since the electrophotographic light-sensitive printing material of this invention has the structure as described above, the light-sensitive printing material is highly sensitive. The light-sensitive printing material of this invention is sufficiently sensitive to make recordings by visible laser light, and is capable of directly making a printing plate by a small-sized and inexpensive apparatus. Furthermore, the material has excellent press power.

The hydrazone compound used in this invention is selected from the hydrazone compounds represented by following general formula (I), (II), (III), (IV), (V) or (VI):

(I)

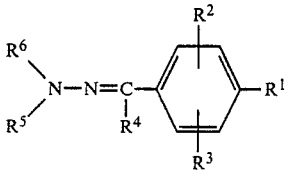

(II)

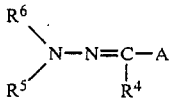

(III)

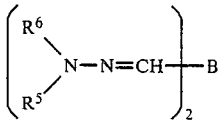

(IV)

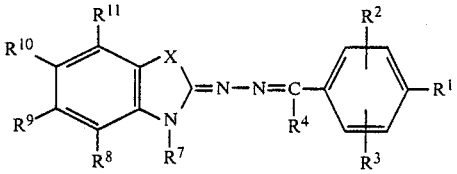

(V)

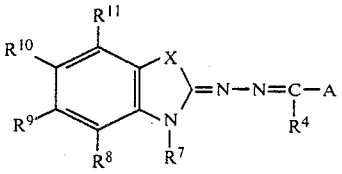

(VI)

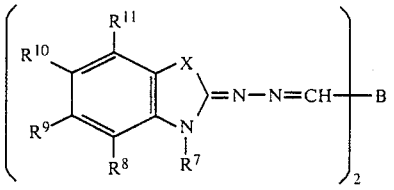

In formulae (I) to (VI):

X represents an oxygen atom, a sulfur atom, a selenium atom, an unsubstituted or substituted imino group, or a methylene group;

$R^1$ represents an alkoxy group, an aralkoxy group, or a substituted amino group shown by

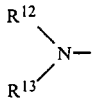

(wherein $R^{12}$ and $R^{13}$, which may be the same or different, each represents an unsubstituted or substituted alkyl or phenyl group or $R^{12}$ and $R^{13}$ may represent groups which are combined with each other to form a heterocyclic ring including nitrogen atom);

$R^2$ and $R^3$, which may be the same or different, each represents a hydrogen atom, a halogen atom, an alkyl group, or a lower alkoxy group;

$R^4$ represents a hydrogen atom, an alkyl group, an unsubstituted or substituted phenyl group;

$R^5$ and $R^6$, which may be the same or different, each represents an unsubstituted or substituted straight chain or branched alkyl group having 1 to 12 carbon atoms, an unsubstituted or substituted straight chain or branched aralkyl group having 7 to 20 carbon atoms, or a monovalent group (aryl group) formed by removing one hydrogen atom from an unsubstituted or substituted monocyclic or 2 to 4 cyclic condensed aromatic hydrocarbon, or $R^5$ and $R^6$ may form a carbazole ring;

$R^7$ represents an unsubstituted or substituted alkyl group;

$R^8$, $R^9$, $R^{10}$, and $R^{11}$, which may be the same or different, each represents a hydrogen atom, a halogen atom, an unsubstituted or substituted alkyl group or phenyl group, an alkoxy group, an aralkoxy group, or an amino group shown by

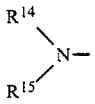

(wherein $R^{14}$ and $R^{15}$ represent a hydrogen atom or the same groups as shown by $R^{12}$ and $R^{13}$ described above), or may combine with each other to form a condensed carbon ring or a condensed heterocyclic ring;

A represents a monocyclic or condensed heterocyclic 5-membered ring or a condensed heterocyclic 6-membered ring shown by the following structural formula:

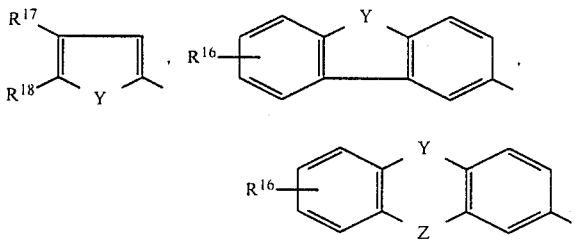

(wherein Y and Z, which may be the same or different, each represents a sulfur atom, an oxygen atom, or N–$R^{17'}$ (wherein $R^{17'}$ is an alkyl group having 1 to 4 carbon atoms); $R^{16}$ represents a hydrogen atom, an alkyl group, an alkoxy group, an aryloxy group, an acyl group, an alkoxycarbonyl group, an aryloxycarbonyl group, a halogen atom, a monoalkylamino group, a dialkylamino group, an amido group or a nitro group; $R^{17}$ and $R^{18}$, which may be the same or different, represent a hydrogen atom, an alkyl group or an alkoxy group, or may be groups which combine with each other to form a benzene ring or a naphthalene ring); and B represents an unsubstituted or substituted aryl group.

As the alkoxy group or aralkyloxy group shown by $R^1$ of general formula (I), there are alkoxy groups having 1 to 12 carbon atoms and aralkyloxy groups having 1 to 12 carbon atoms. Preferred examples of these groups are a methoxy group, an ethoxy group, a propoxy group, a butoxy group, an octyloxy group, and a benzyloxy group.

When $R^1$ is the substituted amino group shown by

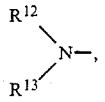

as $R^{12}$ and $R^{13}$, there are an unsubstituted alkyl group having 1 to 12 carbon atoms, such as methyl group, ethyl group, propyl group, butyl group, etc., and an alkyl group of 1 to 12 carbon atoms having the following substituent.

As the substituent for the substituted alkyl groups shown by $R^{12}$ and $R^{13}$, there are an alkoxy group having 1 to 4 carbon atoms, an aryloxy group having 6 to 12 carbon atoms, a hydroxy group, an aryl group having 6 to 12 carbon atoms, a cyano group, and a halogen atom. Preferred examples of the substituted alkyl groups shown by $R^{12}$ and $R^{13}$ are, for example, (a) an alkoxyalkyl group such as methoxymethyl group, a methoxyethyl group, ethoxymethyl group, ethoxypropyl group, methoxybutyl group, propoxymethyl group, etc.; (b) an aryloxyalkyl group such as phenoxymethyl group, phenoxyethyl group, naphthoxymethyl group, phenoxypentyl group, etc.; (c) a hydroxyalkyl group such as hydroxymethyl group, hydroxyethyl group, hydroxypropyl group, hydroxyoctyl group, etc.; (d) an aralkyl group such as benzyl group, phenethyl group, ω,ω-diphenylalkyl group, etc.; (e) a cyanoalkyl group such as cyanomethyl group, cyanoethyl group, cyanopropyl group, cyanobutyl group, cyanooctyl group, etc.; and (f) a haloalkyl group such as chloromethyl group, bromonethyl group, chloroethyl group, bromopentyl group, chlorooctyl group, etc.

Also, the phenyl groups shown by $R^{12}$ and $R^{13}$ may have a substituent and preferred examples of the substituent for the substituted phenyl groups are (a) an alkyl group having 1 to 12 carbon atoms, (b) an alkoxy group having 1 to 4 carbon atoms, (c) an aryloxy group having 6 or 7 carbon atoms, (d) an acyl group having 2 to 8 carbon atoms, (e) an alkoxycarbonyl group having 2 to 5 carbon atoms, (f) a halogen atom, (g) a monoalkylamino group having a substituent of 1 to 4 carbon atoms, (h) a dialkylamino group having a substituent of 1 to 4 carbon atoms, (i) an amido group having 2 to 4 carbon atoms, and (j) a nitro group.

More particularly, (a) preferred examples of the alkyl group having 1 to 12 carbon atoms as the substituent of the substituted phenyl groups shown by $R^{12}$ and $R^{13}$ are methyl group, ethyl group, straight chain or branched propyl group, butyl group, pentyl group, and hexyl group; (b) preferred examples of the alkoxy group having 1 to 4 carbon atoms are methoxy group, ethoxy group, propoxy group, and butoxy group; (c) preferred examples of the aryloxy group are phenoxy group, o-tolyloxy group, m-tolyloxy group, and p-tolyloxy group; (d) preferred examples of the acyl group are acetyl group, propionyl group, benzoyl group, o-toluoyl group, m-toluoyl group and p-toluoyl group; (e) preferred examples of the alkoxycarbonyl group having 2 to 5 carbon atoms are methoxycarbonyl group, ethoxycarbonyl group, propoxycarbonyl group, and butoxycarbonyl group; (f) preferred examples of the halogen atoms are chlorine atom, bromine atom, and fluorine atom; (g) preferred examples of the monoalkylamino group substituted by an alkyl group having 1 to 4 carbon atoms are methylamino group, ethylamino group, and butylamino group; (h) preferred examples of the dialkylamino group substituted by an alkyl group having 1 to 4 carbon atoms are dimethylamino group, diethylamino group, dipropylamino group, dibutylamino group, and N-methyl-N-ethylamino group; (i) preferred examples of the amido group are acetamido group, propionamido group, etc.; and (j) another preferred substituent is a nitro group.

As the heterocyclic rings formed by the combination of $R^{12}$ and $R^{13}$, the heterocyclic rings shown by following structural formulae are preferred:

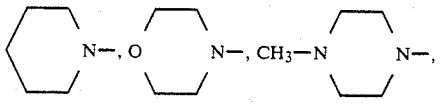

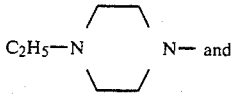

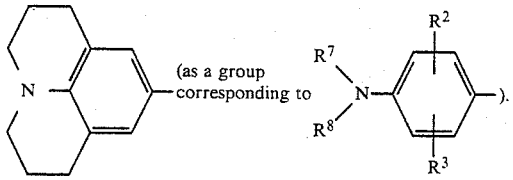

It is preferred that $R^1$ be a substituted amino group in the case where $R^{12}$ and $R^{13}$ are methyl group, ethyl group, benzyl group, phenyl group, or tolyl group. Particularly preferred examples of the substituted amino group shown by $R^1$ are a dimethylamino group, a diethylamino group, a dibenzylamino group, a diphenylamino group, an N-ethyl-N-phenylamino group, etc.

Preferred examples of $R^2$ and $R^3$ are a hydrogen atom; a halogen atom such as chlorine atom, bromine atom, fluorine atom, etc.; an alkyl group having 1 to 4 carbon atoms, such as methyl group, ethyl group, propyl group, butyl group, etc.; and an alkoxy group having 1 to 4 carbon atoms, such as methoxy group, ethoxy group, propoxy group, butoxy group, etc. Preferred examples of these groups are a hydrogen atom, a methyl group, a methoxy group, etc.

Preferred examples of $R^4$ are a hydrogen atom; an alkyl group having 1 to 4 carbon atoms, such as methyl group, ethyl group, propyl group, butyl group, etc., or a phenyl group having or not having substituent. The phenyl group having substituent is the phenyl group having substituent shown by $R^{12}$ or $R^{13}$ as described above. Preferred examples of $R^4$ are a hydrogen atom, a methyl group, an ethyl group, a phenyl group, and a p-(dimethylamino)phenyl group.

The alkyl group having or not having substituent shown by $R^7$ is the same alkyl group which may be substituted as shown by $R^{12}$ or $R^{13}$ described above.

$R^8$, $R^9$, $R^{10}$ and $R^{11}$ are an alkyl group which may be substituted and a phenyl group which may be substituted by the same groups as shown by $R^{12}$ or $R^{13}$ described above. Other examples of these groups are a hydrogen atom; a halogen atom such as chlorine atom, bromine atom, fluorine atom, etc.; an alkoxy group having 1 to 12 carbon atoms, such as methoxy group, ethoxy group, propoxy group, butoxy group, octyl group, benzyloxy group, etc.; an aralkyloxy group having 1 to 12 carbon atoms, such as benzyloxy group, phenethyloxy group, etc.; and the amino group shown by

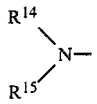

(wherein $R^{14}$ and $R^{15}$ represent a hydrogen atom or the same group as the alkyl or phenyl group which may be substituted shown by $R^{12}$ or $R^{13}$.

$R^8$, $R^9$, $R^{10}$ and $R^{11}$ may be the same or different and they may form a condensed carbon ring such as naphthalene or a condensed heterocyclic ring by combining with each other. In the groups shown by $R^8$, $R^9$, $R^{10}$ and $R^{11}$, a hydrogen atom is particularly preferred.

Preferred examples of $R^{17}$ and $R^{18}$ of

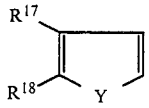

are a hydrogen atom; an alkyl group having 1 to 4 carbon atoms, such as methyl group, ethyl group, propyl group, butyl group, etc.; an alkoxy group having 1 to 4 carbon atoms, such as methoxy group, ethoxy group, propoxy group, butoxy group, etc.; and groups capable of forming a benzene ring or a naphthalene ring by the combination of $R^{17}$ and $R^{18}$.

Preferred examples of $R^{16}$ in the condensed heterocyclic ring

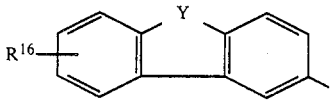

or

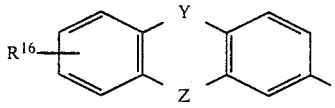

are a hydrogen atom; the alkyl group having 1 to 18 carbon atoms which may be substituted by the same substituent for the alkyl group shown by $R^{22}$ and $R^{13}$ described above, an alkoxy group having 1 to 4 carbon atoms, an aryloxy group having 6 to 10 carbon atoms, an acyl group having 2 to 11 carbon atoms, an alkoxycarbonyl group having 2 to 5 carbon atoms, an aryloxycarbonyl group having 7 to 11 carbon atoms, a monoalkylamino group having 1 to 4 carbon atoms, a dialkylamino group having 1 to 4 carbon atoms, an amido group having 2 to 11 carbon atoms, and a nitro group; these groups may have substituents.

More particularly, preferred examples of the alkoxy group having 1 to 4 carbon atoms shown by foregoing $R^{16}$ are a methoxy group, an ethoxy group, a propoxy group, a butoxy group, etc.; preferred examples of the aryloxy group are a phenoxy group, an o-tolyloxy group, an m-tolyloxy group, and a p-tolyloxy group; preferred examples of the acyl group are an acetyl group, a propionyl group, a benzyl group, an o-toluoyl group, an m-toluoyl group, and a p-toluoyl group; preferred examples of the alkoxycarbonyl group having 2 to 5 carbon atoms are a methoxycarbonyl group, an ethoxycarbonyl group, a propoxycarbonyl group, and a butoxycarbonyl group; preferred examples of the aryloxycarbonyl group having 7 to 11 carbon atoms are a phenoxycarbonyl group, an o-tolyloxycarbonyl group, an m-tolyloxycarbonyl group, and a p-tolyloxycarbonyl group; preferred examples of the halogen atom are chlorine atom, bromine atom, fluorine atom; preferred examples of the monoalkylamino group substituted by an alkyl group having 1 to 4 carbon atoms are a methylamino group, an ethylamino group, and a butylamino group; preferred examples of the dialkylamino group substituted by an alkyl group having 1 to 4 carbon atoms are a dimethylamino group, a diethylamino group, a dipropylamino group, a dibutylamino group, and an N-methyl-N-ethylamino group; preferred examples of the amido group are an acetamido group and a propionamido group; and other substituent is a nitro group.

Preferred examples of the heterocyclic 5-membered ring shown by A are a 2-furyl group, a 2-thienyl group, a 1-methyl-2-pyrrolyl group, and a 5-methyl-2-thienyl group; preferred examples of the condensed heterocyclic 5-membered ring shown by A are a 2-benzo[b]thienyl group, a 2-naphtho[2,3-b]thienyl group, a 9-ethylcarbazol-2-yl group, a dibenzothiophen-2-yl group; and preferred examples of the condensed heterocyclic 6-membered ring shown by A are a 2-phenoxathiinyl group, a 10-phenoxazin-3-yl group, and a 10-ethylphenothiazin-3-yl group as shown by the following formulae:

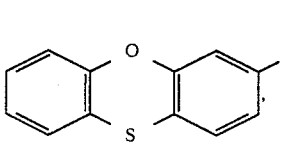

2-phenoxathiinyl group

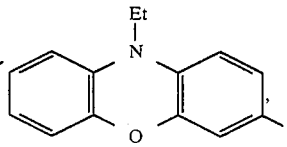

10-ethylphenoxazin-3-yl group

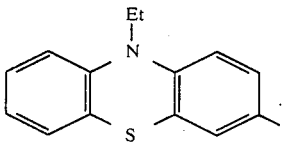

10-ethylphenothiazin-3-yl group

Among these groups, preferred examples are a 5-methyl-2-thienyl group, a 2-benzo[b]thienyl group, a 9-ethylcarbazol-2-yl group, a dibenzothiophen-2-yl group, and 10-ethylphenothiazin-3-yl group.

Preferred examples of B are a phenyl group and a naphthyl group. When these groups have a substituent, the substituent is same as the group shown by $R^2$ or $R^3$.

The hydrazone compounds used in this invention are also described in Japanese Patent Application (OPI) Nos. 59143/79, 150128/79, 46761/80, 5206/80, 52064/80, 74547/80, 84943/80 and 81847/80, and Japanese Patent Application Nos. 85495/80 and 180148/80.

Preferred examples of the hydrazone compounds used in this invention are shown below. In the chemical structures of this specification, Me, Et and Ph show a methyl group, an ethyl group, and a phenyl group, respectively.

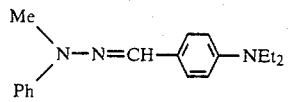
(1)

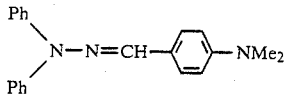
(2)

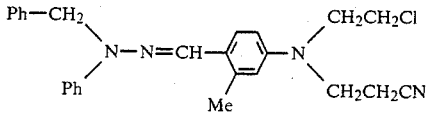
(3)

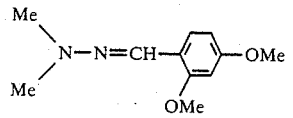
(4)

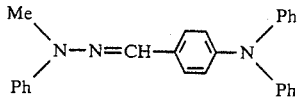
(5)

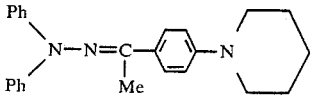
(6)

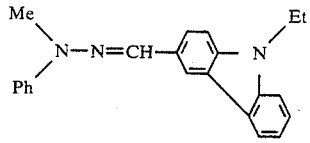
(7)

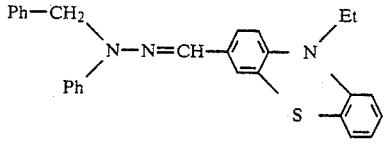
(8)

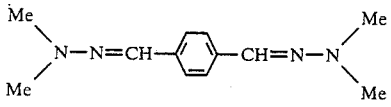
(9)

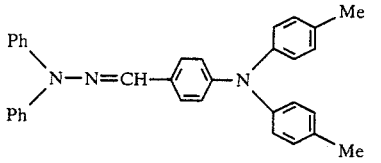
(10)

-continued

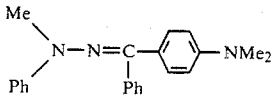
(11)

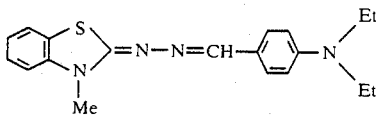
(12)

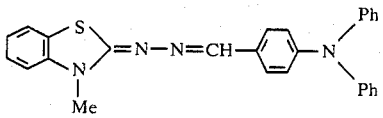
(13)

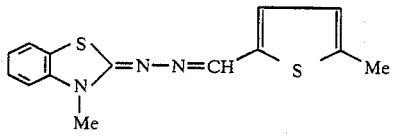
(14)

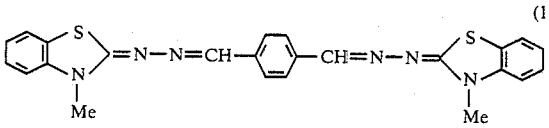
(15)

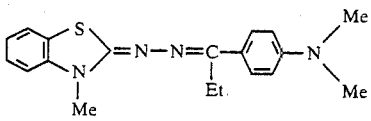
(16)

The barbituric acid derivatives or the thiobarbituric acid derivatives used in this invention are selected from the compounds shown by general formula (VII) or (VIII):

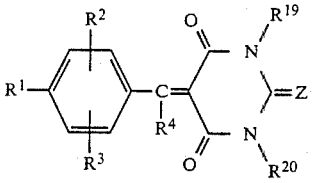
(VII)

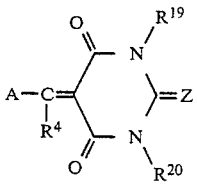
(VIII)

in formulae (VII) and (VIII):

Z represents an oxygen atom or a sulfur atom;

$R^1$, $R^2$, $R^3$, $R^4$ and A have the same significance as defined in general formula (I) and (II); and $R^{19}$ and $R^{20}$, which may be the same or different, each represents an alkyl group, an aralkyl group, or an unsubstituted or substituted phenyl group.

Examples of $R^{19}$ and $R^{20}$ include alkyl groups having from 1 to 12 carbon atoms, such as a methyl group, an ethyl group, a straight or branched propyl group, a butyl group, a pentyl group or a hexyl group, aralkyl groups such as a benzyl group, a phenethyl group or a benzhydryl group, and a phenyl group.

The above described phenyl group may have substituents. Examples of the substituents include the same groups as those in substituted phenyl groups represented by $R^{12}$ and $R^{13}$. Among them, preferred examples include a methyl group, an ethyl group, a phenyl group, or a p-methoxyphenyl group.

The barbituric acid derivatives or thiobarbituric acid derivatives used in this invention are described in Japanese Patent Application Nos. 53125/80, 104209/80 and 4734/81.

Preferred examples of the barbituric acid derivatives and the thiobarbituric acid derivatives used in this invention are illustrated below.

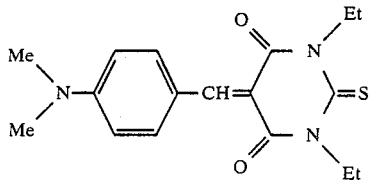
(17)

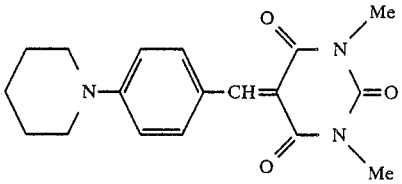
(18)

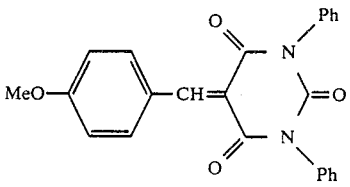
(19)

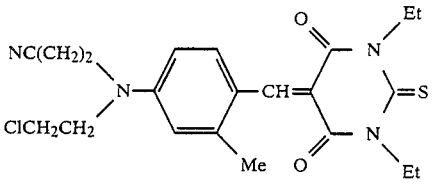
(20)

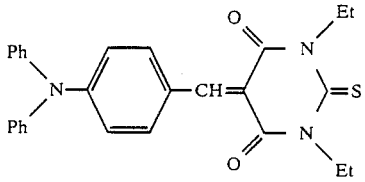
(21)

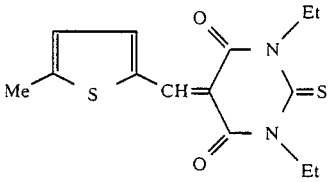
(22)

-continued

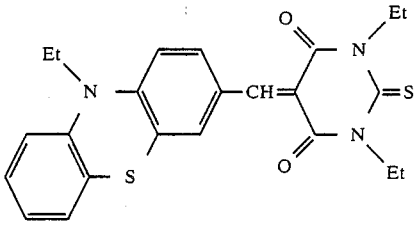
(23)

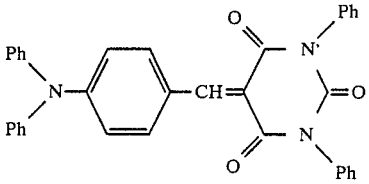
(24)

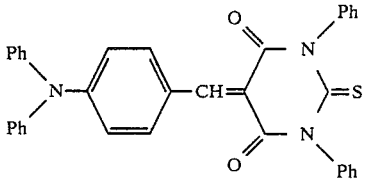
(25)

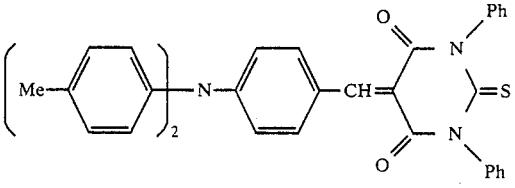
(26)

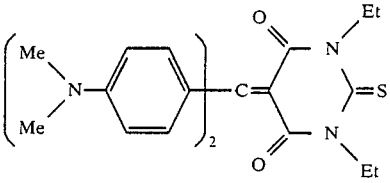
(27)

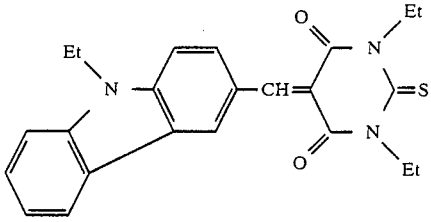
(28)

In the above-described compounds, the thiobarbituric acid derivatives wherein $R^{19}$ and $R^{20}$ are unsubstituted or substituted phenyl groups and Z is a sulfur atom are particularly preferred in this invention.

The charge generating materials used in this invention are selected from following compounds (1) to (14):

(1) Cationic dyes:

That is, triphenylmethane dyes such as Malachite Green (C.I. 42,000), Crystal Violet (C.I. 42,555), etc.; thiazine dyes such as Methylene Blue (C.I. 52,015), Methylene Green (C.I. 52,020), etc.; oxazine dyes such as Capryl Blue (C.I. 51,015), etc.; astrazone dyes such as Astrazone Orange R (C.I. 48,040), Astrazone Yellow 3GL (C.I. 48,035), Astrazone Red 6B (C.I. 48,020), etc.; cyanine dyes such as Aizen Astra Phloxine FF (C.I. 48,070), etc.; xanthene dyes such as Rhodamine B (C.I. 45,170), etc.; and pyrylium dyes such as 2,6-diphenyl-4-

(N,N-dimethylaminophenyl)thiapyrylium perchlorate, benzopyrylium salts (described in Japanese Patent Publication No. 25658/73), etc. In these compounds, astrazone dyes are preferred.

(2) Perylene series pigments such as perylenic acid anhydride, perylenic acid imide, etc.

(3) Indigoid dyes.

(4) Quinacridone dyes.

(5) Polycyclic quinones such as anthraquinones, pyrenequinones, anthanthrones, flavanthrones, etc.

(6) Bisbenzimidazole pigments.

(7) Squaric compounds.

(8) Indanthrone pigments.

(9) Phthalocyanine pigments such as metallic phthalocyanine and non-metallic phthalocyanine.

(10) Azo dyes such as monoazo dyes and disazo dyes.

(11) Charge transferring complexes each composed of an electron donor such as poly-N-vinylcarbazole and an electron acceptor such as trinitrofluorenone.

(12) Eutectic complexes each composed of a pyrylium salt dye and a polycarbonate resin.

(13) Selenium and selenium alloys.

(14) Inorganic photoconductors such as CdS, CdSe, CdSSe, ZnO, ZnS, etc.

In these charge generating materials, phthalocyanine pigments (9), azo dyes (10), and charge transferring complexes (11) are preferred and among them the phthalocyanine pigments (9) are particularly preferred.

As the resin binders used in this invention, natural or synthetic resins are suitable in the points of film-forming property, adhesive property, and press power. In the case of selecting the binder, the solubility is particularly important in addition to the film-forming property, electric properties, the adhesive property to a carrier base, and the press power. From the viewpoint of practical use, a resin binder which is soluble in an aqueous or alcoholic solvent with, as the case may be, the addition of an acid or an alkali is particularly suitable. For reasons of physiology and safety, a resin binder soluble in an aromatic or aliphatic combustible solvent is unsuitable. A resin binder advantageously used in this invention is a high molecular material having a group capable of imparting alkali solubility to the material. Examples of such a group are an acid anhydride group, a carboxy group, a phenolic hydroxy group, a sulfonic acid group, a sulfonamido group, and a sulfonimido group.

A copolymer having an acid anhydride group or a carboxy group and a phenol resin can be used with good results in this invention. The photosensitive layer containing the copolymer or the phenol resin as a binder shows a low dark decay and has a high press power in spite of the fact that the copolymer or the phenol resin is alkali-soluble.

As a copolymer having an acid anhydride group, a copolymer of styrene and maleic anhydride is preferred.

As a copolymer having a carboxy group, a copolymer of acrylic acid or methacrylic acid and the alkyl ester or aralkyl ester of acrylic acid or methacrylic acid represented by general formula (IX) is preferred:

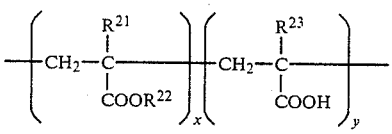

(IX)

wherein $R^{21}$ and $R^{23}$, which may be the same or different, each represents a hydrogen atom or a methyl group; $R^{22}$ represents an alkyl group having 1 to 18 carbon atoms, such as methyl group, ethyl group, propyl group, butyl group, etc., or an aralkyl group having 7 to 12 carbon atoms, such as benzyl group, phenethyl group, 3-phenylpropyl group, etc.; in particular, the case where both $R^{21}$ and $R^{23}$ are a methyl group and $R^{22}$ is a benzyl group being preferred; and the mole ratio y/x is 5 to 60%, preferably 10 to 50%.

Of the copolymers having a carboxy group described above, copolymers of benzyl acrylate and methacrylic acid are particularly preferred in that they imparting great press power as shown in the examples described later.

Of the phenol resins used in this invention as a resin binder, a novolak resin obtained by condensing phenol, o-cresol, m-cresol, or p-cresol and formaldehyde or acetaldehyde under an acidic condition is preferred. The mean molecular weight of the phenol resins used in this invention is preferably 350 to 20,000, more preferably 350 to 6,000.

Of the conductive base plates used in this invention, conductive base plates having a hydrophilic surface, for example, a plastic sheet having a conductive surface, a paper subjected to a solvent impermeable treatment and a conductive treatment, an aluminum sheet, a zinc sheet, a bimetal sheet such as a copper-aluminum sheet, a copper-stainless steel sheet, a chromium-copper sheet, etc., and a trimetal sheet such as a chromium-copper-aluminum sheet, a chromium-zinc-iron sheet, a chromium-copper-stainless steel sheet, etc., are used. The thickness of the base plate is preferably 0.1 to 3 mm, more preferably 0.1 to 1 mm.

In the case of a support or a base plate having an aluminum surface, it is preferred that the support be subjected to a surface treatment such as graining, immersion in an aqueous solution of sodium silicate, zirconium fluoride, potassium fluorozirconate, a phosphate, etc., or anodic oxidation. Also, the aluminum sheet subjected to graining and then an immersion treatment in an aqueous solution of sodium silicate as described in U.S. Pat. No. 2,714,066 and the aluminum sheet subjected to an anodic oxidation and then an immersion treatment in an aqueous solution of an alkali metal silicate as described in Japanese Patent Publication No. 5125/72 are preferably used in this invention.

The foregoing anodic oxidation is practiced by passing an electric current using an aluminum sheet as an anode in an electrolyte composed of an aqueous solution or a non-aqueous solution of an inorganic acid such as phosphoric acid, chromic acid, sulfuric acid, boric acid, etc., an organic acid such as oxalic acid, sulfamic acid, etc., or a salt thereof solely or as a combination of these solutions.

Furthermore, the silicate electrodeposition as described in U.S. Pat. No. 3,658,662 is effectively utilized in this invention. Also, the treatment by polyvinylsulfonic acid as described in West German Patent Application (OLS) No. 1,621,478 is suitably used.

Such hydrophilic treatments are applied for preventing the occurrence of a harmful reaction with an electrophotographic light-sensitive layer formed on the surface of the support. The treatment also improves the adhesion of the support to the electrophotographic light-sensitive layer in addition to rendering the surface of the support hydrophilic.

In this invention, an alkali-soluble interlayer composed of casein, polyvinyl alcohol, ethyl cellulose, a phenol resin, a styrene-maleic anhydride copolymer, polyacrylic acid, etc., may be formed between the aforesaid conductive base plate and an electrophotographic light-sensitive layer. The interlayer improves the adhesion of the foregoing base plate and the electrophotographic light-sensitive layer as well as the electrostatic characteristics of the electrophotographic light-sensitive layer.

An overcoat layer which can be dissolved off at the removal of the electrophotographic light-sensitive layer may be formed on the electrophotographic light-sensitive layer. The overcoat layer improves the electrostatic characteristics of the electrophotographic light-sensitive layer, the development characteristics at toner development and/or the image characters. The overcoat layer may be a mechanically matted layer or a resin layer containing a matting agent. Examples of matting agents include: silicon dioxide, zinc oxide, titanium oxide, zirconium oxide, glass particles, alumina, starch, and polymer particles (e.g., particles of polymethyl methacrylate, polystyrene, phenol resin, etc.) as well as the matting agents described in U.S. Pat. Nos. 2,710,245 and 2,992,101. They can be used alone or in mixtures. A resin used for the resin layer containing the matting agent is properly selected in accordance with the combination with a solution for removing the electrophotographic light-sensitive layer used. Practical examples of the resin include: gum arabic, glue, gelatin, casein, celluloses (e.g., viscose, methyl cellulose, ethyl cellulose, hydroxyethyl cellulose, hydroxypropylmethyl cellulose, carboxymethyl cellulose, etc.), starches (e.g., soluble starch, denatured starch, etc.), polyvinyl alcohol, polyethylene oxide, polyacrylic acid, polyacrylamide, polyvinyl methyl ether, an epoxy resin, a phenol resin (e.g., preferably a novolak-type phenol resin), polyamide and polyvinyl butyral. They can be used alone or in mixture.

The amounts of the hydrazone compounds, the resin binder, the barbituric acid derivative or the thiobarbituric acid derivative, and the charge generating material used in this invention are as follows: i.e., the amount of the resin binder is 0.1 to 100 parts by weight, preferably 0.5 to 10 parts by weight per 1 part by weight of the hydrazone compound and the amount of the barbituric acid derivative or the thiobarbituric acid derivative is 0.001 to 20 parts by weight per 1 part by weight of the hydrazone compound. The amount of the charge generating material is 0.0001 to 0.1 mole, preferably 0.001 to 0.05 mole per mole of the hydrazone compound in the case of the cationic dye (1) and is 0.0001 to 1 part by weight, preferably 0.001 to 0.5 part by weight per 1 part by weight of the resin binder in the case of the materials (2) to (14) described above as the charge generating materials.

The electrophotographic light-sensitive printing material of this invention is prepared by almost uniformly mixing the hydrazone compound, the resin binder, and at least one of the barbituric acid derivative, thiobarbituric acid derivative and charge generating material described above together with a solvent to form a coating composition (a solution or a dispersion). The composition is coated on the surface of the foregoing conductive base plate through, if necessary, the foregoing interlayer. Drying is then carried out to form an electrophotographic light-sensitive layer. When using the barbituric acid derivative or the thiobarbituric acid derivative as the charge generating material, the coating composition is frequently prepared as a homogeneous solution since the barbituric acid derivative or thiobarbituric acid derivative is dissolved in various organic solvents and has good compatibility with a resin binder. When a pigment such as a phthalocyanine pigment and an azo dye which is not dissolved in an organic solvent and which shows poor compatibility with a resin binder is used as the charge generating material, the charge generating material is dispersed in a solvent as fine particles thereof. The charge generating material (pigment) can be pulverized into fine particles of a mean particle size of less than 10 μm, preferably 2 μm using a known means such as ball mill. In this case, an overcoat layer may be formed on the electrophotographic light-sensitive layer.

It is further possible to incorporate various additives such as surface active agents, plasticizers, polycarbonate, and polyvinyl carbazole, in the electrophotographic light-sensitive layers.

The dry thickness of the electrophotographic light-sensitive layer thus formed on the conductive base plate is 1 to 100 μm, preferably 2 to 50 μm.

Solvents useful for uniformly mixing the above described components include halogenated hydrocarbons such as dichloromethane, dichloroethane and chloroform; alcohols such as methanol and ethanol; ketones such as acetone, methyl ethyl ketone and cyclohexane; glycol ethers such as ethylene glycol monomethyl ether, ethylene glycol monoethyl ether, 2-methoxyethylacetic acid and dioxane; and esters such as butyl acetate and ethyl acetate.

A printing plate is made using the electrophotographic light-sensitive material of this invention in the following manner. The electrophotographic light-sensitive layer is substantially uniformly charged in the dark by an ordinary manner. The layer is then subjected to reflection image exposure using a xenon lamp, halogen lamp, tungsten lamp, or fluorescent lamp as the light source; a scanning exposure or image exposure by laser light such as semiconductor laser, argon laser, He-Ne laser, etc.; or a contact image exposure through a positive transparent. Next, the light-sensitive layer is developed by a toner to form a toner image. Thereafter, the electrophotographic light-sensitive layer is removed at the non-image areas carrying no toner (no toner image areas) uncovering the surface of the base plate at these areas, thereby a printing plate is obtained.

The toner image may be formed by a conventional electrophotographic process, such as a cascade development, a magnetic brush development, a powder cloud development, a liquid development, etc. After development, the toner image may be fixed by a known method such as heat fixing, pressure fixing, etc.

When making a printing plate from the electrophotographic light-sensitive printing plate of this invention, after toner development, the non-image portions of the electrophotographic light-sensitive layer carrying no toner are removed to form a resist comprising toner image portions. Therefore, it is preferred that the toner composition contains a resin component being resistant to etching solution used for removing the electrophotographic light-sensitive layer.

Examples of resin components include resins which are resistant to etching solution used for removing the electrophotographic light-sensitive layer. Specific examples of such resin components are acrylic resins using methacrylic acid, methacrylic acid ester, etc.; a vinyl acetate resin, a copolymer of vinyl acetate and ethylene or vinyl chloride, a vinyl chloride resin, a vinylidene chloride resin, a vinyl acetal resin such as polyvinyl acetal, polystyrene, a copolymer of styrene and butadiene or methacrylic acid ester, polyethylene, polypropylene or a chloride thereof, polyester resins (e.g., polyethylene terephthalate, polyethylene isophthalate, polycarbonate of bisphenol A, etc.), polyamide resins (e.g., polycapramide, polyhexamethylene adipoamide, polyhexamethylene sebacamide, etc.), a phenol resin, a xylene resin, an alkyd resin, a vinyl-denatured alkyd resin, gelatin, cellulose derivatives such as carboxymethyl cellulose, etc., wax, polyolefin, etc.

In this invention, with regard to the relation between the toner and the conductive base plate having an oily printing ink repelling property, in many cases the toner is oleophilic and the base plate is hydrophilic but in this case, the oleophilic extent and the hydrophilic extent are relative ones. That is, the oily ink repelling property of the surface of the base plate means that when the toner image portion is adjacent to an uncovered surface of the base plate, an oily printing ink must not attach to and remain on the surface of the base plate. The hydrophilic property of the surface of the base plate means that when the toner image portion is adjacent to the disclosed surface of a base plate, the surface of the base plate must not have a strong repellency to water and must not be able to retain water thereon. The oleophilic property of the toner means that the toner image portion must not have a strong repellency to an oily printing ink and must not be able to retain an oily printing ink on the toner portion. The surface of the conductive base plate may have an oily printing ink repelling property and have water repellency (hydrophobic property).

An etching solution used for removing the non-toner image areas of the electrophotographic light-sensitive layer after the formation of the toner image can be selected according to the electrophotographic light-sensitive layer and the toner components. Examples of etching solutions include an aqueous alkaline solution such as an aqueous solution of sodium silicate or sodium phosphate and an organic amine such as ethanolamine, which may contain an organic solvent such as ethanol, benzyl alcohol, ethylene glycol, glycerol, etc., and a surface active agent.

The electrophotographic light-sensitive printing material of this invention may further contain a quinonediazide compound (e.g., o-naphthoquinonediazide) or a diazonium compound for improving the solubility of the electrophotographic light-sensitive layer by overall light-exposure after the formation of the toner image.

Furthermore, when using the electrophotographic light-sensitive material of this invention, two kinds of printing plates, i.e., a posi-posi (positive working) printing plate and a nega-posi (negative working) printing plate can be desirably selected using one kind of a liquid developer by utilizing both positive and negative charging properties. This is possible by utilizing a reversal development in a liquid development process. Industrially, this process is a very useful printing plate making process.

The electrophotographic light-sensitive printing material of this invention is used for making printing plates (for planography or relief printing) having a high resolving power, a good durability, and high sensitivity by etching the light-sensitive layer after the formation of a toner image.

The hydrazone compound contained in the electrophotographic light-sensitive layer of the electrophotographic light-sensitive material of this invention has a good compatibility with a resin binder. The barbituric acid derivative or the thiobarbituric acid derivative used in this invention also has good compatibility with the resin binder. When the hydrazone compound is used as a combination with the barbituric acid derivative or the thiobarbituric acid derivative, when making printing plate, improvements are obtained. For example, the surface of the printing plate has an excellent ink receptive property since the electrophotographic light-sensitive layer has good uniformity. Furthermore, the images obtained by printing have good resolving power and are clear since the edge of the image is flat. In addition, the electrophotographic light-sensitive layer containing a combination of the hydrazone compound and the barbituric acid derivative or the thiobarbituric acid derivative, a combination of the hydrazone compound and the phthalocyanine pigment, or a combination of the hydrazone compound and the azo dye has a very sensitive light-sensitive layer. Furthermore, the electrophotographic light-sensitive layer containing a combination of the hydrazone compound, the barbituric acid derivative or the thiobarbituric acid derivative, and the copolymer having a carboxyl group shown by the general formula (IX) described before, or a combination of the hydrazone compound, the phthalocyanine pigment, and the copolymer having a carboxyl group shown by the general formula (IX) has a very sensitive light-sensitive layer. Also, the printing plate made by using the light-sensitive printing plate has very high press power.

The invention will be further explained more practically by the following examples. However, the invention is not restricted by these examples. In addition, in the examples, the parts are all parts by weight.

EXAMPLE 1

In 8 parts of methylene chloride were dissolved 0.4 parts of the hydrazone compound (5), 1.0 part of a copolymer of benzyl methacrylate and methacrylic acid ($[\eta]_{methyl\ ethyl\ ketone}^{30°\ C.}$: 0.12, methacrylic acid 32.9 mol%), and 0.1 part of the thiobarbituric acid derivative (25). The solution was coated on a grained aluminum sheet 0.25 mm thick and dried to provide an electrophotographic light-sensitive printing material having an electrophotographic light-sensitive layer.

The sample was corona discharged (+6 kv) in the dark to charge the light-sensitive layer at a surface potential of about +600 volts and then when the surface of the sample was exposed to a tungsten light of a color temperature of 2,854° K. at an illumination of 30 lux, the half decay exposure amount was 19 lux·sec.

Then, the sample was charged at a surface potential of about +400 volts in the dark and then image exposed in contact with a transparent of a positive image. The sample was immersed in a liquid developer containing a toner prepared by dispersing 5 g of polymethyl methacrylate (toner) and 0.01 g of soybean oil lecithin in 1 liter of Isoper H (a petroleum solvent, made by Esso Standard Co.) as fine particles, thereby clear positive toner images could be obtained.

Furthermore, the toner images thus obtained were fixed by heating for 30 sec to 100° C. The printing plate material was immersed in a solution prepared by dissolving 70 g of sodium metasilicate hydrate in a mixture of 140 ml of glycerol, 550 ml of ethylene glycol, and 150 ml of ethanol for about 1 minute and washed with running water while lightly brushing the surface. Thereby the electrophotographic light-sensitive layer was removed at the portions carrying no toner.

Also, in place of using the liquid developer, electrostatic images obtained on the electrophotographic light-sensitive layer by following the procedure as described above were subjected to magnetic brush development using a toner of Xerox 3500 (the trade name, made by Fuji Xerox Co.) and then fixed by heating the developed images to 80° C. for 30 sec. Then, the light-sensitive layer was removed at the portions carrying no toner with an alkaline aqueous solution. Thereby a printing plate was obtained.

When each of the printing plates thus produced was printed on a Hamadaster 600 CD offset press (trade name) using offset papers, 50,000 very clear prints having no stain in the background portions were obtained.

EXAMPLE 2

A sample was prepared by following the same procedure as in Example 1 except that the following components were dissolved in 8 parts of methylene chloride:

| | |
|---|---|
| Hydrazone compound (1) | 0.4 part |
| Copolymer of benzyl methacrylate and methacrylic acid (same as used in Example 1) | 1.0 part |
| Thiobarbituric acid derivative (21) | 0.2 part |

and the surface potential thereof was 580 volts and the half decay exposure amount thereof was 42 lux·sec. Also, by following the same printing plate making process as in Example 1, an offset printing plate was produced.

EXAMPLES 3-7

Electrophotographic light-sensitive printing materials were prepared by following the same procedure as in Example 2 except that the hydrazone compounds (3), (7), (8), (11) and (13) were used in place of the hydrazone compound (5) in the example. When they were measured as in Example 2, the half decay light exposure amounts of them at an electric field intensity of $10^6$ (volt/cm) were 51, 62, 40, 90 and 87 luxes, respectively.

Furthermore, by following the same procedure as in Example 1 on each of the samples thus prepared, a good offset printing plate could be prepared.

EXAMPLE 8

A sample was prepared by following the same procedure as in Example 1 except that the following components were dissolved in 8 parts of methylene chloride:

| | |
|---|---|
| Hydrazone compound (5) | 0.8 part |
| Copolymer of benzyl methacrylate and methacrylic acid | 1.0 part |
| Thiobarbituric acid derivative (20) | 0.2 part |

and then measured as in Example 1. The half decay exposure amount at an electric field intensity of $10^6$ (volt/cm) was 64 lux·sec.

By following the same procedure as in Example 1, a good offset printing plate was prepared.

EXAMPLES 9-11

Electrophotographic light-sensitive printing materials were prepared by following the procedure as in Example 8 except that the (thio)barbituric acid derivatives (23), (24) and (28) were used in place of the thiobarbituric acid derivative (20). When they were measured as in Example 8, the half decay exposure amounts at an electric field intensity of $10^6$ (volt/cm) were 52, 88 and 55 luxes·sec, respectively.

By following the same procedure as in Example 1, good offset printing plates were prepared.

EXAMPLE 12

A sample was prepared as in Example 1 except that the sample was charged negatively and measured as in the same example, the half decay exposure amount was 72 lux·sec.

The sample was charged to about −350 volts in the dark and was image-exposed in a contact state with a transparent of a positive original. Then, by immersing the sample in a liquid developer containing toner prepared by adding 5 g of fine particles of polymethyl methacrylate (toner) and 0.01 g of zirconium naphthenate in 1 liter of Isoper H (trade name, made by Esso Standard Oil Co.), clear positive toner images could be obtained. Furthermore, by following the same procedure as in Example 1, a good offset printing plate could be made.

EXAMPLE 13

In a mixed solvent of 8 parts of methylene chloride and 5 parts of methyl cellosolve acetate were dissolved the following components:

| | |
|---|---|
| Hydrazone compound (5) | 0.8 part |
| SMA-2000A (trade name of a copolymer of styrene and maleic anhydride at 2:1, made by Arco Chemical Co.) | 1 part |

Furthermore, the astrazone dye having the following structural formula was added to the solution in $10^{-2}$ mole per mole of the hydrazine compound (5):

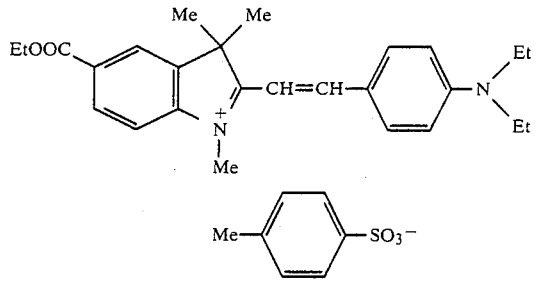

An electrophotographic light-sensitive layer of about 5 μm thick was formed as in Example 1 and after charging the light-sensitive layer to +220 volts, image-exposed. In this case, the half decay exposure amount was 120 lux·sec.

By following the same procedure as in Example 1, a good offset printing plate was made.

EXAMPLE 14

An electrophotographic light-sensitive printing material was prepared by following the same procedure as in Example 1 except that the following components were dissolved in 8 parts of methylene chloride:

| | |
|---|---|
| Hydrazone compound (1) | 0.5 part |
| Copolymer of benzyl methacrylate | 1.0 part |

-continued

| | |
|---|---|
| and methacrylic acid (same as used in Example 1) | |
| β-type copper phthalocyanine (Microlith Blue 4GT, trade name, made by Chiba-Geigy Corporation) | 0.05 part |

The light-sensitive material was subjected to corona discharging (+6 kv) in the dark as in Example 1 to charge the electrophotographic light-sensitive layer to +710 volts at the surface potential. When the electrophotographic characteristics were measured, the half decay exposure amount was 10.5 lux·sec.

By following the same procedure as in Example 1, a good planographic printing plate was obtained. By performing planographic printing as in Example 1, 50,000 very clear prints could be obtained without staining the backgrounds as in Example 1.

EXAMPLE 15

Two parts of chlorodian blue shown by the following structure was added to 100 parts of dichloromethane and the mixture was pulverized in a ball mill to prepare a dispersion. To the dispersion thus obtained was added a solution comprising 1 part of hydrazone compound (1) and 2 parts of a copolymer of benzyl methacrylate and methacrylic acid dissolved in 20 parts of dichloromethane, to prepare a coating dispersion for electrophotographic light-sensitive layer. The electrophotographic light-sensitive printing plate was obtained according to the same procedure as is described in Example 1.

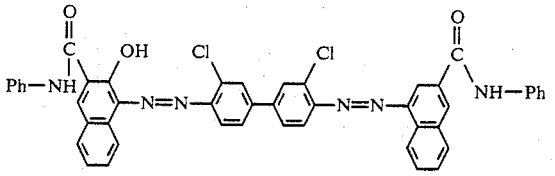

When the light-sensitive printing material was subjected to corona discharging as in Example 1, the surface potential of the electrophotographic light-sensitive layer was +490 volts and the half decay exposure amount was 14.3 lux·sec. By following the same procedure as in Example 1, an excellent planographic printing plate as in Example 1 was obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive printing material comprising a conductive base plate having formed thereon an electrophotographic light-sensitive layer containing (a) a hydrazone compound, (b) at least one compound selected from a barbituric acid derivative, a thiobarbituric acid derivative, and other charge generating materials, and (c) a resin binder, wherein said hydrazone compound is one member selected from the group consisting of the following general formulas (I), (II), (III), (IV), (V), and (VI):

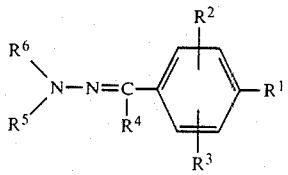

(I)

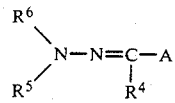

(II)

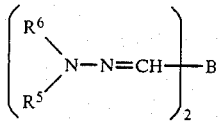

(III)

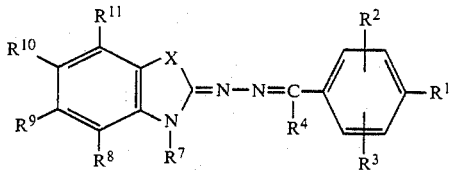

(IV)

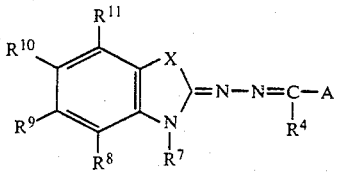

(V)

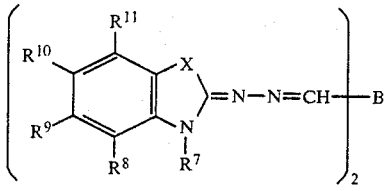

(VI)

wherein X represents an oxygen atom, a sulfur atom, a selenium atom, an unsubstituted or substituted imino group, or a methylene group; $R^1$ represents an alkoxy group, an aralkoxy group, or a substituted amino group shown by

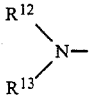

wherein $R^{12}$ and $R^{13}$, which may be the same or different, each represents an unsubstituted or substituted alkyl or phenyl group or $R^{12}$ and $R^{13}$ may represent groups which are combined with each other to form a heterocyclic ring including nitrogen atom; $R^2$ and $R^3$, which may be the same or different, each represents a hydrogen atom, a halogen atom, an alkyl group, or a lower alkoxy group; $R^4$ represents a hydrogen atom, an alkyl group, an unsubstituted or substituted phenyl group; $R^5$ and $R^6$, which may be the same or different, each represents an unsubstituted or subtituted straight chain or branched alkyl group having 1 to 12 carbon atoms, an unsubstituted or substituted straight chain or branched aralkyl group having 7 to 20 carbon atoms, or a monovalent group, aryl group, formed by removing one hydrogen atom from an unsubstituted or substituted monocyclic or 2 to 4 cyclic condensed aromatic hydrocarbon, or $R^5$ and $R^6$ my form a carbazole ring; $R^7$ represents an unsubstituted or substituted alkyl group; $R^8$, $R^9$, $R^{10}$, and $R^{11}$ which may be the same or different, each represents a hydrogen atom, a halogen atom, an unsubstituted or substituted alkyl group or phenyl group, an alkoxy group, an aralkoxy group, or an amino group shown by

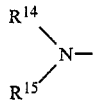

wherein $R^{14}$ and $R^{15}$ represent a hydrogen atom or the same groups as shown by $R^{12}$ and $R^{13}$ described above, or may combine with each other to form a condensed carbon ring or a condensed heterocyclic ring; A represents a monocyclic or condensed heterocyclic 5-membered ring or condensed heterocyclic 6-membered ring shown by the following structural formula:

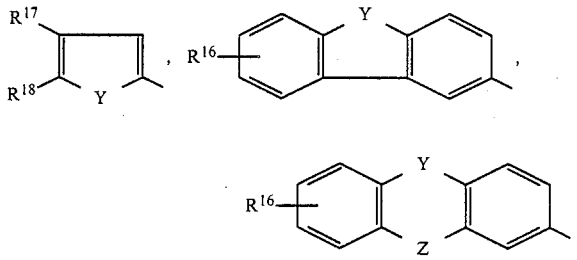

wherein Y and Z, which may be the same or different, each represents a sulfur atom, an oxygen atom, or N-$R^{17'}$ wherein $R^{17'}$ is an alkyl group having 1 to 4 carbon atoms, $R^{16}$ represents a hydrogen atom, an alkyl group, an alkoxy group, an aryloxy group, an acyl group, an alkoxycarbonyl group, an aryloxycarbonyl group, a halogen atom, a monoalkylamino group, a dialkylamino group, an amido group or a nitro group, $R^{17}$ and $R^{18}$, which may be the same or different, represent a hydrogen atom, an alkyl group or an alkoxy group, or may be groups which combine with each other to form a benzene ring or a naphthalene ring; and B represents an unsubstituted or substituted aryl group; and wherein said barbituric acid derivative or thiobarbituric acid derivative is at least one member selected from the group consisting of the following general formulas (VII) and (VIII):

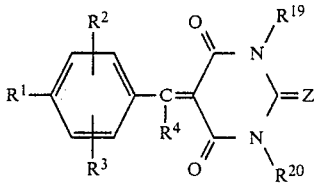

(VII)

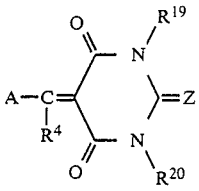

(VIII)

wherein Z represents an oxygen atom or a sulfur atom; $R^1$, $R^2$, $R^3$, $R^4$ and A are the same as defined above; and $R^{19}$ and $R^{20}$, which may be the same or different, each represents an alkyl group, an aralkyl group, or an unsubstituted or substituted phenyl group.

2. The electrophotographic light-sensitive printing material as claimed in claim 1, wherein said component (b) is at least one compound selected from a barbituric acid derivative and a thiobarbituric acid derivative.

3. The electrophotographic light-sensitive printing material as claimed in claim 1, wherein said component (b) is at least one phthalocyanine pigment selected from a metallic phthalocyanine and a nonmetallic phthalocyanine.

4. The electrophotographic light-sensitive printing material as claimed in claim 1, wherein said component (b) is at least one azo dye selected from monoazo dyes and disazo dyes.

5. The electrophotographic light-sensitive printing material as claimed in claim 1, wherein said component (c) is a copolymer of styrene and maleic anhydride.

6. The electrophotographic light-sensitive printing material as claimed in claim 1, wherein said component (c) is a copolymer having a carboxyl group represented by general formula (IX):

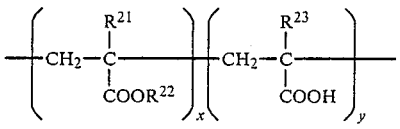

(IX)

wherein $R^{21}$ and $R^{23}$ independently represent a hydrogen atom or a methyl group; $R^{22}$ represents an alkyl group having 1 to 18 carbon atoms or an aralkyl group having 7 to 12 carbon atoms; and the ratio y/x is 5–60/100.

7. The electrophotographic light-sensitive material as claimed in claim 6, wherein $R^{22}$ in the general formula (IX) is a group selected from the groups consisting of a benzyl group, a phenethyl group, or a 3-phenylpropyl group and the ratio y/x is 10–50/100.

8. The electrophotographic light-sensitive printing material as claimed in claim 1, wherein said component (c) is a novolak resin prepared by condensing a compound selected from the group consisting of phenol, o-cresol, m-cresol, or p-cresol with formaldehyde or acetaldehyde.

* * * * *